US008782852B1

(12) United States Patent
Henderson

(10) Patent No.: US 8,782,852 B1
(45) Date of Patent: Jul. 22, 2014

(54) MULTIPLE MOTOR VACUUM CHECK VALVE

(76) Inventor: Jon T. Henderson, Jackson, MO (US)

( * ) Notice: Subject to any disclaimer, the term of this patent is extended or adjusted under 35 U.S.C. 154(b) by 346 days.

(21) Appl. No.: 13/150,408

(22) Filed: Jun. 1, 2011

Related U.S. Application Data

(60) Provisional application No. 61/350,405, filed on Jun. 1, 2010.

(51) Int. Cl.
*A47L 9/28* (2006.01)
*A47L 5/22* (2006.01)

(52) U.S. Cl.
USPC ..... 15/412; 15/327.2

(58) Field of Classification Search
CPC ..... A47L 9/22; A47L 5/28; A47L 9/009; A47L 9/00; A47L 5/362; A47L 5/365
USPC ..... 15/412, 327.1, 327.2, 327.6, 339
See application file for complete search history.

(56) References Cited

U.S. PATENT DOCUMENTS

| | | | | |
|---|---|---|---|---|
| 3,775,951 | A | 12/1973 | Eichholz et al. | |
| 4,036,346 | A | 7/1977 | Livingston | |
| 4,218,805 | A * | 8/1980 | Brazier | 15/321 |
| 4,287,636 | A * | 9/1981 | Brazier | 15/321 |
| 4,591,368 | A | 5/1986 | MacDuff | |
| 4,651,380 | A | 3/1987 | Ogden | |
| 4,654,926 | A * | 4/1987 | McCambridge | 15/327.6 |
| 4,688,293 | A | 8/1987 | McCambridge | |
| 4,934,017 | A * | 6/1990 | Kent | 15/321 |
| 4,939,809 | A * | 7/1990 | Park | 15/328 |
| 5,005,251 | A | 4/1991 | McLeod et al. | |
| 5,168,599 | A | 12/1992 | Williams | |
| 5,205,014 | A * | 4/1993 | Yoo | 15/353 |
| 5,367,726 | A | 11/1994 | Chaffee | |
| 5,618,410 | A | 4/1997 | Wallace et al. | |
| 6,550,086 | B2 | 4/2003 | Boyd | |
| 7,624,474 | B1 | 12/2009 | Cho | |
| 2003/0196292 | A1 | 10/2003 | Sams et al. | |

* cited by examiner

*Primary Examiner* — Dung Van Nguyen
(74) *Attorney, Agent, or Firm* — CreatiVenture Law, LLC; Dennis JM Donahue III

(57) ABSTRACT

A vacuum system has multiple vacuum motors and a receptacle in fluid communication with each of the motors. Each of the motors has a check valve that has an opening spaced apart from the respective vacuum motor by a distance at least as great as an effective diameter of the vacuum motor's inlet. Each of the check valves preferably has an airflow clearance that is at least as great as said effective diameter, and the check valves may also include warning signals that can indicate working motors and a bad motor.

20 Claims, 3 Drawing Sheets

MULTIPLE MOTOR VACUUM CHECK VALVE

CROSS-REFERENCE TO RELATED APPLICATIONS

This application claims priority from U.S. Provisional Patent Application No. 61/350,405 filed on Jun. 1, 2010.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to vacuum machines and more particularly to an improved check valve system for vacuum machines with multiple motors.

2. Related Art

Multiple motor vacuum systems are generally known in the art of vacuum machines. For wet vacuums that are used to suck water and other liquids, it is generally known to use float valves in the air flow path between the vacuum motor and the canister to prevent the liquid from being ingested into the motor. In U.S. Pat. No. 5,005,251, a plate valve with vanes on a backside has also been taught to avoid recirculation of the airflow in a multiple vacuum system when one of the vacuum motors is not working properly. The vanes provide a standoff distance between the plate and the intake port to the vacuum motor, allowing airflow in the plenum around the sides of the plate and preventing the backside face of the plate from covering the intake port. However, the vaned-plate valve is not an optimum solution for providing unrestricted airflow when all vacuum motors are working properly and for preventing recirculation of air through a motor that is not working properly. Accordingly, there remains the need for satisfactory valves in a multiple motor vacuum system.

SUMMARY OF THE INVENTION

In one aspect of the present invention, a vacuum system has multiple vacuum motors in fluid communication with a receptacle, each of which has a check valve that has an opening spaced apart from the respective vacuum motor by a distance at least as great as an effective diameter of the vacuum motor.

In another aspect of the present invention, a vacuum system has multiple vacuum motors, each of which has a check valve and a warning signal that works in concert with its respective check valve to provide an indication of a bad motor, i.e., a motor that is not working while at least one of the other motors is working.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
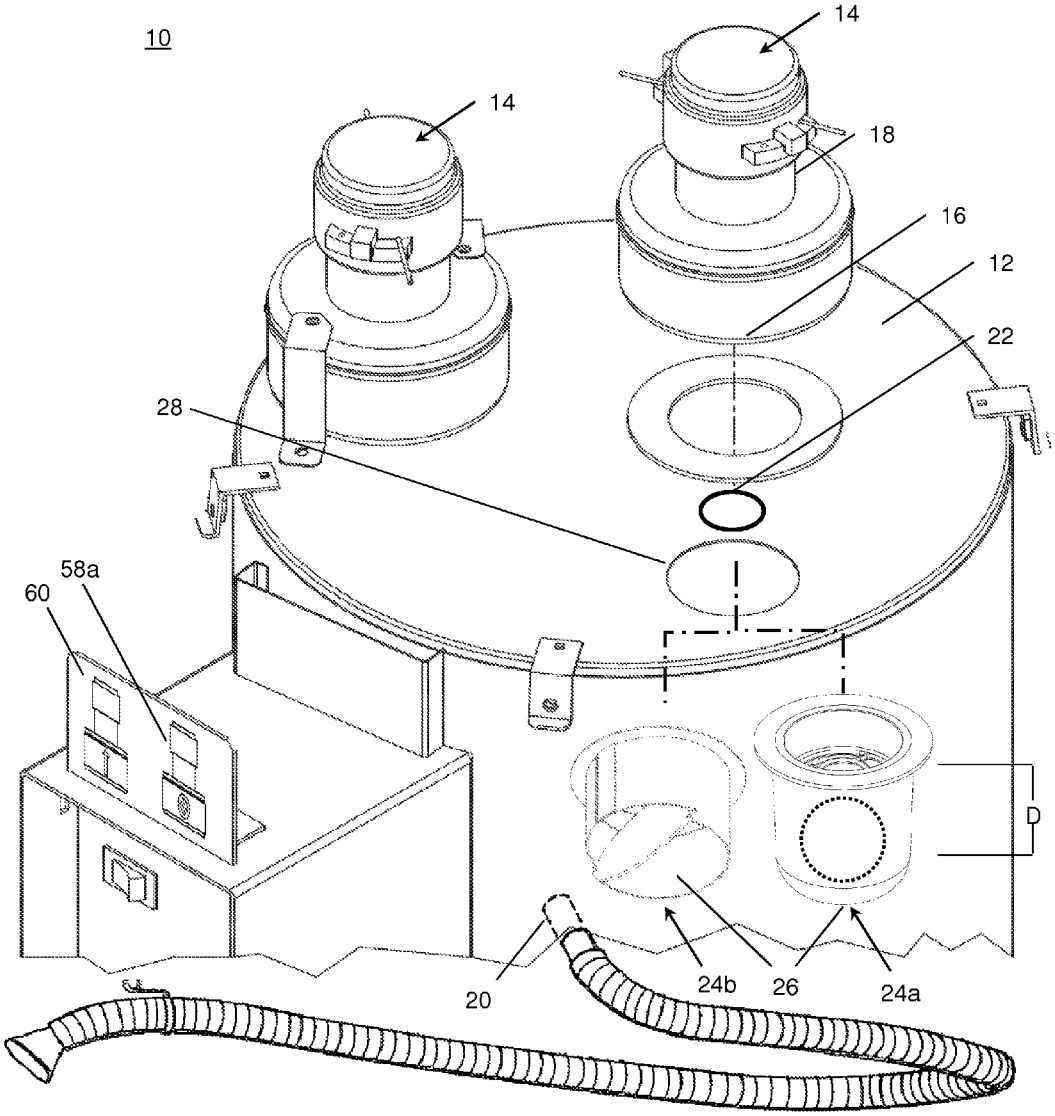
FIG. 1 is an isometric view of a canister vacuum with multiple motors.

As illustrated in FIG. 1, a vacuum system 10 has a receptacle 12 which is in fluid communication with vacuum motors 14. Each of the vacuum motors has an air inlet 16 and an air outlet 18 spaced apart from the inlet Air and debris are sucked through an intake port 20 in the receptacle 12 that is in fluid communication with the vacuum motors' air intakes. The air flows through the receptacle and the debris is deposited within the receptacle. Each of the vacuum motors also has an effective diameter 22 for an airflow rate through the inlet and the air outlet. Each of the motors is in fluid communication with a respective check valve 24 which has an opening 26 that is spaced apart from the port 28 to the respective vacuum motor by a distance (D) at least as great as the length of the effective diameter 22.

Figure 2A:
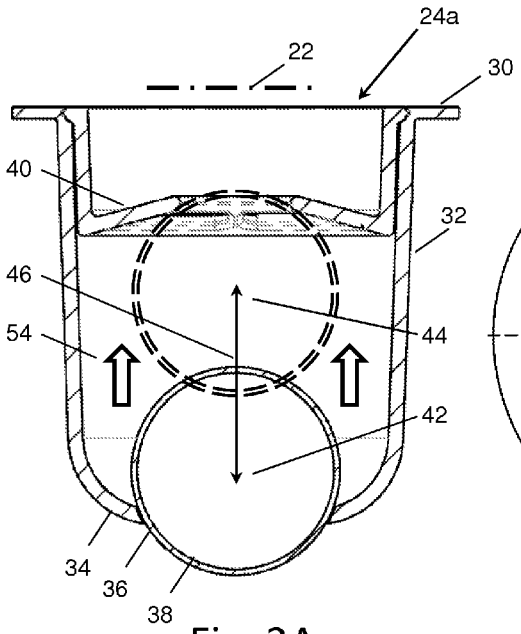
FIGS. 2A & 2B are elevation cross-sectional and plan views, respectively, of a ball valve.
Figure 2B:
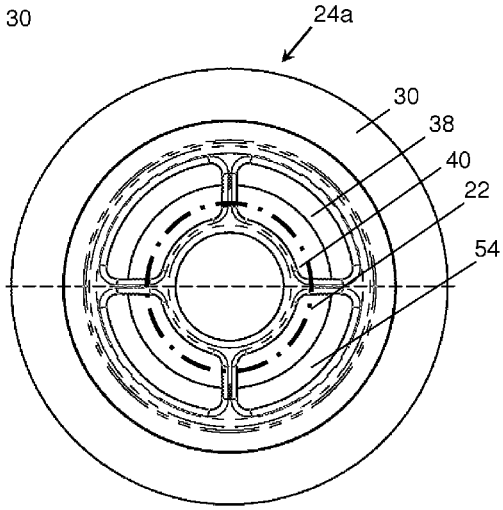

In the embodiment shown by FIGS. 2A and 2B, the check valve 24 is a ball valve 24*a* with a flange 30 that fits around the receptacle's vacuum motor port 28. The ball check valve has a housing that is generally in the shape of a cylinder 32 which extends into the receptacle and has a semispherical cap 34 at its distal end. A circular hole 36 is provided in the center of the cap, and a ball 38 with a diameter that is approximately one third to one half of the cylinder's diameter and is larger than the hole. The size of the hole is preferably equal to or slightly larger than the effective diameter of the vacuum motor's inlet. A grate 40 is provided in the ball check valve upstream of the vacuum motor's inlet to keeps the ball from blocking the airflow into the inlet by being sucked into the inlet when the vacuum motor is operating.

The ball 38 loosely fits within the cylindrical housing 32 between the central hole 36 and the grate 40. The ball has a gravity-biased position 42 proximal to the central hole 36 when the vacuum motor is not operating and a vacuum-enabled position 44 proximal to the grate 40 when the vacuum motor is operating. The ball has a freedom of movement 46*a* between the central hole and the grate with a distance at least equal to the effective diameter. While some vacuum motors may have sufficient strength to pull the ball all the way up to touch the grate in the vacuum-enabled position, the system does not necessarily require this extreme positioning of the ball for unrestricted airflow through the valve. The freedom of movement for the ball generally allows the ball to be pulled away from the central hole by a distance that allows for the free flow of air through the valve without any choking or sharp turns in the airflow.

It will be appreciated that other shapes could be used for the ball check valve, such as a conical frustum (not shown). Additionally, different sized check valves could be used depending on the size of the receptacle's vacuum motor port. Similarly, a standard size check valve may be used with varying sizes of receptacle's vacuum motor ports by using flange adapters with an internal diameter that fits the standard size and having different outer diameters corresponding with the varying sizes of vacuum motor ports and fitting within the available area within the vacuum motor's respective mounting brackets. Generally, the vacuum motors 14 are positioned externally to the receptacle 12 and the preferred check valves 24 of the present invention have cylindrical housings extending away from the vacuum motor inlets and into the receptacle by a distance at least equal to the effective diameter.

Figure 3A:
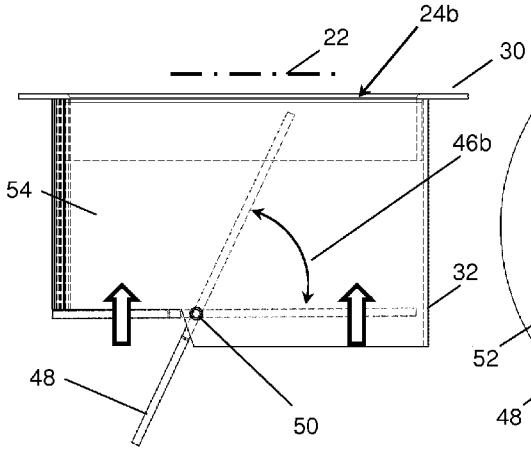
FIGS. 3A & 3B are elevation cross-sectional and plan views, respectively, of a flap valve.
Figure 3B:
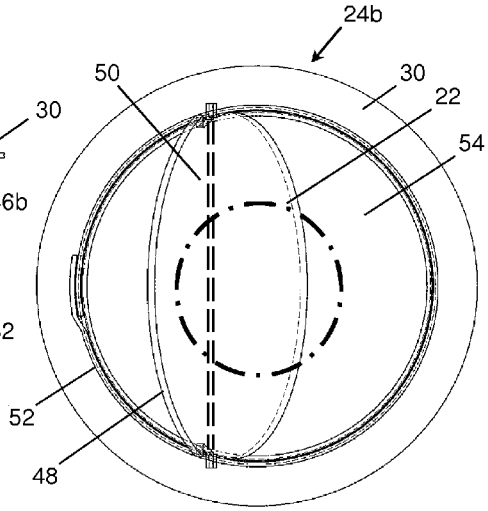
Figure 4:
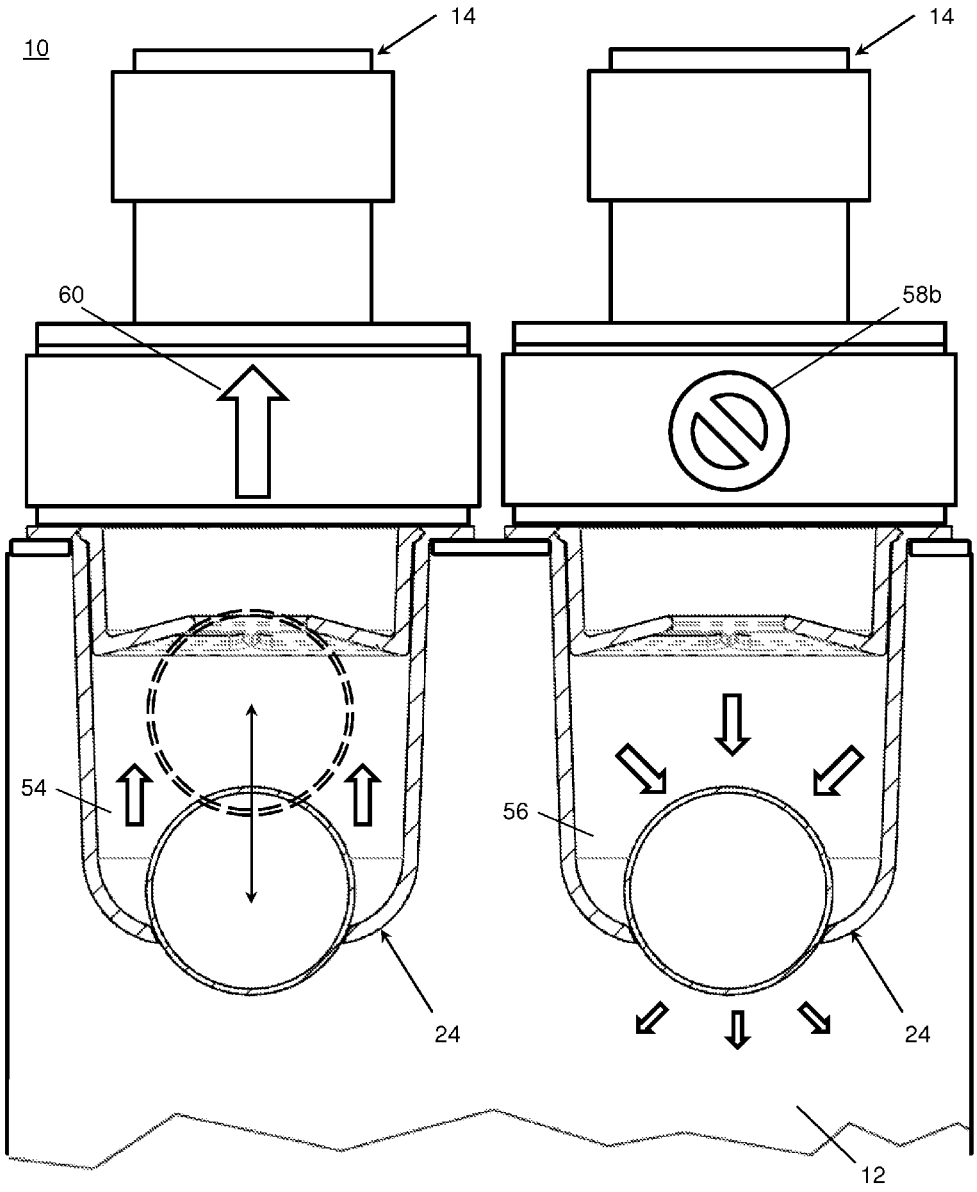
FIG. 4 is a cross-sectional view of a canister vacuum with one motor failed.

In another embodiment shown by FIGS. 3A and 3B, the check valve 24 is a swing valve 24*b* or other type of flap valve that is rotatably secured 46*b* toward the distal end of the cylinder 32 extending into the receptacle. The shape of the flap 48 in the swing valve is similar to the perimeter shape of the cylinder (i.e., circular flap for a circular cylinder). The axis 50 of the flap may be offset from the center which helps stabilize the flap when air is flowing though the cylinder and provides a gravity-biased closed position for the flap when the vacuum motor 14 is off or has failed. When the vacuum motor is in operation, one side of the flap rotates toward the inlet (preferably the larger side) while the other smaller side rotates away from the inlet. When the flap is closed, its outer edges are preferably in contact with an inner flange element 52 that runs around the inner circumference of the cylinder. To allow free rotation of the flap, the flap is preferably arranged such that the inner flange contacts the upstream side of the larger flap section and the downstream side of the smaller flap section.

Other one-way valves could also be used for the check valve in the present invention as long as they are spaced properly that provides an airflow clearance 54 that is at least as great as the effective diameter and that preferably have passageways with rounded corners rather than sharp corners. The particular type of one-way valve can be a matter of design choice depending on the particular installation of the vacuum motors in the vacuum system. For example, in the present invention, with the motors mounted at the top of the canister, very simple gravity-biased one-way valves work well, such as the floating ball valve and the swing valve or flap valve. However, it will be appreciated that a stop valve may also be used. The stop valve can be gravity-biased or may be spring-loaded. In other vacuum system configurations, such as where the vacuum is below the receptacle as in an upright vacuum, the spring-loaded stop valve may be the best alternative, although it is possible that a gravity biased valve may still be useful. For the top-mounted vacuum motor arrangement, each check valve is preferably positioned between the inlet and the receptacle. It will also be appreciated that a stop valve may not require any spring and could also be biased closed by gravity.

In operation, when one of the vacuum motors fails and is inoperative and at least one other vacuum motor works and is operative, the check valve for the inoperative motor is in its gravity-biased closed position and/or is pulled closed by the pressure differential 56 between ambient pressure at the air outlet side of the inoperative motor and the sub-ambient pressure within the receptacle. The vacuum system 10 of the present invention may also have a bad motor warning signal 58 that works in conjunction with the check valve to provide an indication of the inoperative vacuum motor. The bad motor warning signal may be an electronic warning system 58*a* or a mechanical warning system. As one example of a mechanical warning system, a whistle element 58*b* may be added to the check valve such that when the motor is inoperative, a small amount of air is permitted to flow though the check valve to create a whistling warning signal. It will be appreciated that the vacuum system may also include good motor signals 60.

In describing the present invention, a canister-type vacuum system 10 has been used for the preferred embodiment of the invention. However, other types of multiple-motor vacuum systems can incorporate the present invention, such as the upright vacuum suggested above. Accordingly, it will be appreciated that the flow path for upright vacuum machines are likely to be different from the flow path in canister vacuum machines and modifications can be made to the check valve to accommodate these changes. For example, in the preferred canister vacuum embodiment, the air outlet is in fluid communication with the intake port through the receptacle. Therefore, the air outlet of the motor also serves as the exhaust port for the receptacle. In many upright vacuum machines, where the vacuum motor's air outlet is upstream of the receptacle and the receptacle has a separate exhaust port for the airflow, the air outlet may be better suited for the check valve.

It will further be appreciated that the present invention can be used in any vacuum system in which there are multiple motors, and ordinary modifications could be made to the system depending on the receptacle's shape and orientation. The receptacle can be any type of container, vessel or chamber which permits the airflow through the system and traps the debris, and such systems can use a bag or can be bag-less and may also incorporate one or more filters.

In addition to the check valves described above and shown in the corresponding drawings, any type of one-way valve can be used for the check valve in accordance with the teachings of this invention. It will be further appreciated that the check valve is preferably on the inlet side of the vacuum motors, but the check valve could alternatively be placed on outlet side of the vacuum motors.

The check valve of the present invention can be installed as an improvement to existing multiple-motor vacuum systems that do not have a check valve. Alternatively, the check valve of the present invention can be incorporated into the design of new multiple-motor vacuum systems or incorporated into the design of the vacuum motors themselves. For the installation of the check valves of the present invention into existing top-mounted motor vacuum systems, the vacuum motor is first removed from its mounts to reveal the vacuum motor port. The check valve is then installed in the vacuum motor port, and the motor is reinstalled back onto its mounts. This process is repeated for each of the vacuum motors.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A vacuum system, comprising:

an intake port;

a receptacle in fluid communication with said intake port;

a plurality of vacuum motors, wherein each of said vacuum motors has an inlet in fluid communication with said intake port and has an air outlet spaced apart from said inlet, and wherein each of said vacuum motors has an effective diameter for an airflow rate through said inlet and said air outlet; and a plurality of check valves, wherein each of said check valves is respectively in fluid communication with said vacuum motors, and wherein each of said check valves has an opening spaced apart from said respective vacuum motor inlet by a distance at least as great as said effective diameter, wherein at least one of said vacuum motors is inoperative while at least another of said vacuum motors is operative, wherein each of said check valves has an airflow clearance that is at least as great as said effective diameter, and wherein said check valve in fluid communication with said inoperative motor is pulled closed by a pressure differential between an ambient pressure at said air outlet side of said inoperative motor and a sub-ambient pressure within said receptacle.

2. The invention of claim 1, wherein said air outlet is in fluid communication with said intake port through said receptacle, and wherein said check valves are selected from the group of one-way valves consisting of a floating ball valve, a flap valve, a swing valve, a stop valve and any combination thereof.

3. The invention of claim 1, wherein said vacuum motors are positioned externally to said receptacle and wherein each of said check valves is comprised of a cylindrical housing extending away from said vacuum motors and into said receptacle by a distance at least equal to said effective diameter.

4. The invention of claim 3, wherein said cylindrical housing further comprises a semispherical cap at a distal end and a central hole in said semispherical cap, wherein said central hole has a diameter approximately equal to or larger than said effective diameter, and wherein said cylindrical housing further comprises a grate at a proximal end, and wherein a ball loosely fits within said cylindrical housing between said central hole and said grate, wherein said ball has a diameter greater than said central hole, said ball having a gravity-biased position proximal to said central hole when said vacuum motor is not operating and a vacuum-enabled position proximal to said grate when said vacuum motor is operating and wherein said ball has a freedom of movement between said central hole and said grate with a distance at least equal to said effective diameter.

5. The invention of claim 1, wherein said check valves are also in a biased closed position when said vacuum motors are off.

6. The invention of claim 5, further comprising a bad motor warning signal in operative communication with said check valve, said bad motor warning signal providing an indication of said inoperative vacuum motor.

7. The invention of claim 6, wherein said bad motor warning signal is selected from the group of devices consisting of an electronic warning system, a mechanical warning system and any combination thereof.

8. A vacuum system, comprising:

an intake port;

a receptacle in fluid communication with said intake port;

a plurality of vacuum motors, wherein each of said vacuum motors has an inlet in fluid communication with said intake port and has an air outlet spaced apart from said inlet, and wherein each of said vacuum motors has an effective diameter for an airflow rate through said inlet and said air outlet;

a plurality of check valves, wherein each of said check valves is respectively in fluid communication with said vacuum motors, and wherein each of said check valves has an opening spaced apart from said respective vacuum motor by a distance at least as great as said effective diameter; and a bad motor warning signal in operative communication with said check valve.

9. The invention of claim 8, wherein said bad motor warning signal is selected from the group of devices consisting of an electronic warning system, a mechanical warning system and any combination thereof.

10. The invention of claim 8, wherein said bad motor warning signal comprises a whistle in each said of said check valves.

11. The invention of claim 8, wherein each of said check valves is a floating ball valve.

12. The invention of claim 8, wherein said check valves are selected from the group of one-way valves consisting of a floating ball valve, a flap valve, a swing valve, a stop valve and any combination thereof.

13. The invention of claim 8, wherein at least one of said vacuum motors is inoperative while at least another of said vacuum motors is operative, wherein each of said check valves has an airflow clearance that is at least as great as said effective diameter, and wherein said check valve in fluid communication with said inoperative motor is in a biased closed position when said vacuum motors are off and is also pulled closed by a pressure differential between an ambient pressure at said air outlet side of said inoperative motor and a sub-ambient pressure within said receptacle.

14. An improved vacuum system of the type comprising a plurality of vacuum motors and a receptacle in fluid communication with each of the vacuum motors, wherein each of the vacuum motors has an effective diameter for an airflow rate through the inlet and the air outlet, wherein the improvement comprises:

a plurality of check valves, wherein each of said check valves is respectively in fluid communication with the vacuum motors, wherein each one of said check valves is in a biased closed position when said vacuum motors are off, and wherein each of said check valves has an opening spaced apart from the respective vacuum motor by a distance at least as great as said effective diameter.

15. The invention of claim 14, wherein at least one of the vacuum motors is inoperative while at least another of the vacuum motors is operative, wherein each of said check valves has an airflow clearance that is at least as great as said effective diameter, and wherein said check valve in fluid communication with the inoperative motor is pulled closed by a pressure differential between an ambient pressure at said air outlet side of the inoperative motor and a sub-ambient pressure within the receptacle.

16. The invention of claim 14, further comprising a bad motor warning signal in operative communication with each of said check valves.

17. An improved vacuum system of the type comprising a plurality of vacuum motors and a receptacle in fluid communication with each of the vacuum motors, wherein each of the vacuum motors has an effective diameter for an airflow rate through an inlet and an air outlet, wherein the improvement comprises:

a plurality of check valves, wherein each of said check valves is respectively in fluid communication with the vacuum motors, and wherein each of said check valves has an opening spaced apart from the respective vacuum motor by a distance at least as great as said effective diameter, and wherein at least one of the vacuum motors is inoperative while at least another of the vacuum motors is operative, wherein each of said check valves has an airflow clearance that is at least as great as said effective diameter, and wherein said check valve in fluid communication with the inoperative motor is pulled closed by a pressure differential between an ambient pressure at said air outlet side of said inoperative motor and a sub-ambient pressure within the receptacle.

18. The invention of claim 17, wherein each of said check valves is comprised of a cylindrical housing extending away from the vacuum motors and into the receptacle by a distance at least equal to said effective diameter, said cylindrical housing extending to a distal end with a semispherical cap, wherein said semispherical cap comprises a central hole, wherein said central hole has a diameter approximately equal to or larger than said effective diameter, and wherein said cylindrical housing further comprises a grate at a proximal end, and wherein a ball loosely fits within said cylindrical housing between said central hole and said grate, wherein said ball has a diameter greater than said central hole, said ball having a gravity-biased position proximal to said central hole when said vacuum motor is not operating and a vacuum-enabled position proximal to said grate when said vacuum motor is operating and wherein said ball has a freedom of movement between said central hole and said grate with a distance at least equal to said effective diameter.

19. The invention of claim 18, further comprising a bad motor warning signal in operative communication with each of said check valves, wherein said bad motor warning signal comprises a whistle in each said of said check valves, wherein said check valves are selected from the group of one-way valves consisting of a floating ball valve, a flap valve, a swing valve, a stop valve and any combination thereof.

20. The invention of claim 17, wherein each of said check valves is also in a biased closed position when said vacuum motors are off.

* * * * *